US010413918B2

(12) United States Patent
Sell

(10) Patent No.: US 10,413,918 B2
(45) **Date of Patent: *Sep. 17, 2019**

(54) DOSING DISPENSERS AND METHODS FOR USING THE SAME

(71) Applicant: Silgan Dispensing Systems Corporation, Grandview, MO (US)

(72) Inventor: Steven A. Sell, Lee's Summit, MO (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/997,364

(22) Filed: Jun. 4, 2018

(65) Prior Publication Data

US 2018/0280996 A1 Oct. 4, 2018

Related U.S. Application Data

(63) Continuation of application No. 15/276,159, filed on Sep. 26, 2016, now Pat. No. 9,987,641.

(60) Provisional application No. 62/232,564, filed on Sep. 25, 2015.

(51) Int. Cl.

| | |
|---|---|
| ***B05B 1/30*** | (2006.01) |
| ***B05B 7/12*** | (2006.01) |
| ***B05B 7/04*** | (2006.01) |
| ***B05B 7/24*** | (2006.01) |
| ***B05B 15/30*** | (2018.01) |

(52) U.S. Cl.
CPC ..... *B05B 1/302* (2013.01); *B05B 7/0408* (2013.01); *B05B 7/1209* (2013.01); *B05B 7/244* (2013.01); *B05B 7/2443* (2013.01); *B05B 15/30* (2018.02); *B05B 1/3026* (2013.01)

(58) Field of Classification Search
CPC ..... B05B 1/302; B05B 7/4808; B05B 7/1209; B05B 7/244; B05B 15/005
USPC ..... 222/547, 481, 481.5; 239/310, 525, 354
See application file for complete search history.

(56) References Cited

U.S. PATENT DOCUMENTS

| | | | | |
|---|---|---|---|---|
| 4,901,923 | A | 2/1990 | McRoskey et al. | |
| 7,237,728 | B1 | 7/2007 | Laible | |
| 8,726,939 | B2 * | 5/2014 | Laible | B05B 7/12 137/892 |
| 2002/0008161 | A1 * | 1/2002 | Ketcham | B05B 7/2443 239/310 |
| 2005/0284959 | A1 | 12/2005 | Hubmann et al. | |
| 2006/0091237 | A1 | 5/2006 | Dodd | |
| 2008/0237369 | A1 | 10/2008 | Hubmann et al. | |
| 2012/0234935 | A1 * | 9/2012 | Sun | B05B 1/3013 239/10 |

* cited by examiner

*Primary Examiner* — Lien M Ngo
(74) *Attorney, Agent, or Firm* — Barlow, Josephs & Holmes, Ltd.

(57) ABSTRACT

A dosing dispenser system and a dosing dispenser include a slidable control configured to allow a user to select a desired mixing ratio for a product contained in a container attached to the dosing dispenser with a transport medium, such as water, flowing through the dosing dispenser.

16 Claims, 14 Drawing Sheets

DOSING DISPENSERS AND METHODS FOR USING THE SAME

CROSS-REFERENCE TO RELATED APPLICATIONS

This application is a continuation of U.S. application Ser. No. 15/276,159, filed Sep. 26, 2016 entitled "DOSING DISPENSERS AND METHODS FOR USING THE SAME," which claims the benefit of U.S. Provisional Application No. 62/232,564, entitled "DOSING DISPENSERS AND METHODS FOR USING THE SAME," filed 25 Sep. 2015, and incorporates the same herein by reference in its entirety.

BACKGROUND OF THE INVENTION

Field of the Invention

Embodiments of the invention relate to dispensers for dosing a product from a container into a larger vessel and in particular for dosing chemical or product concentrates into a larger container utilizing an adjustable flow control system.

State of the Art

Dispensers of many different forms are used to dispense products as desired. Some dispensers are used to dispense a chemical concentrate at different flow rates into larger containers. For example, U.S. Pat. No. 6,988,675, which is incorporated herein by reference in its entirety, describes such systems.

While various flow control and chemical concentrate dispensers exist, many include a plethora of parts, are expensive to manufacture, and are difficult to assemble. Therefore, systems having fewer parts, less cost, or which are easier to manufacture and assemble are desirable.

BRIEF SUMMARY OF THE INVENTION

According to various embodiments of the invention, a dose dispensing system includes a bottle or container and a dosing dispenser attached thereto. The dosing dispenser may include a valve for regulating an amount of fluid flow from a container attached to the dosing dispenser through the dosing dispenser. In some embodiments of the invention, a valve or dose regulator may be combined with or part of a sliding component or dosing control of the dispenser allowing a user to select a desired dose to be output with a stream of water.

BRIEF DESCRIPTION OF THE DRAWINGS

While the specification concludes with claims particularly pointing out and distinctly claiming particular embodiments of the invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

According to various embodiments of the invention, a dose dispensing system may include a bottle or container 900 and a dosing dispenser 100 attached thereto. The dosing dispenser 100 may include components as illustrated in FIGS. 1 through 15.

Figure 1:
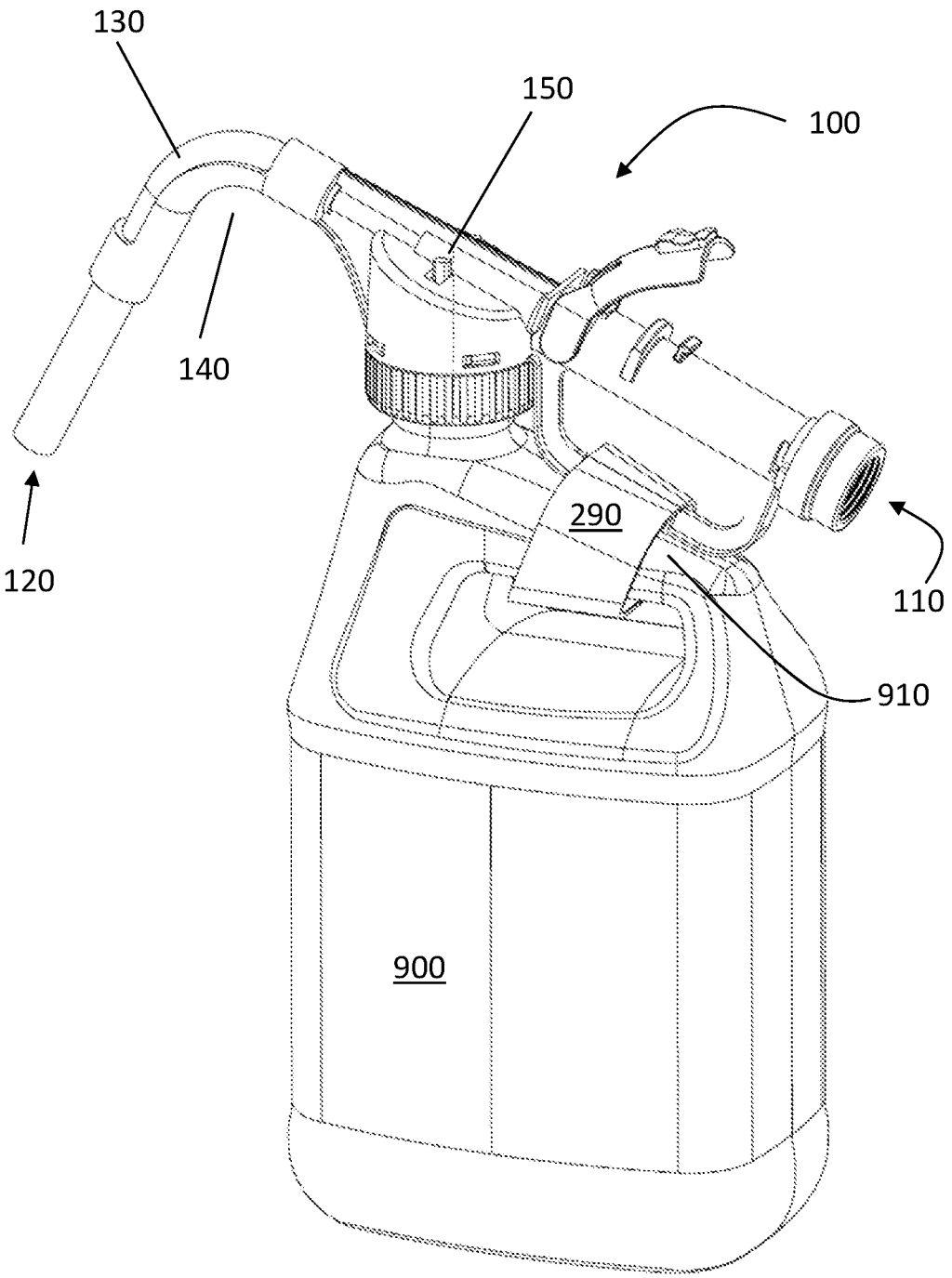
FIG. 1 illustrates a perspective view of a dose dispensing system according to various embodiments of the invention.
Figure 2:
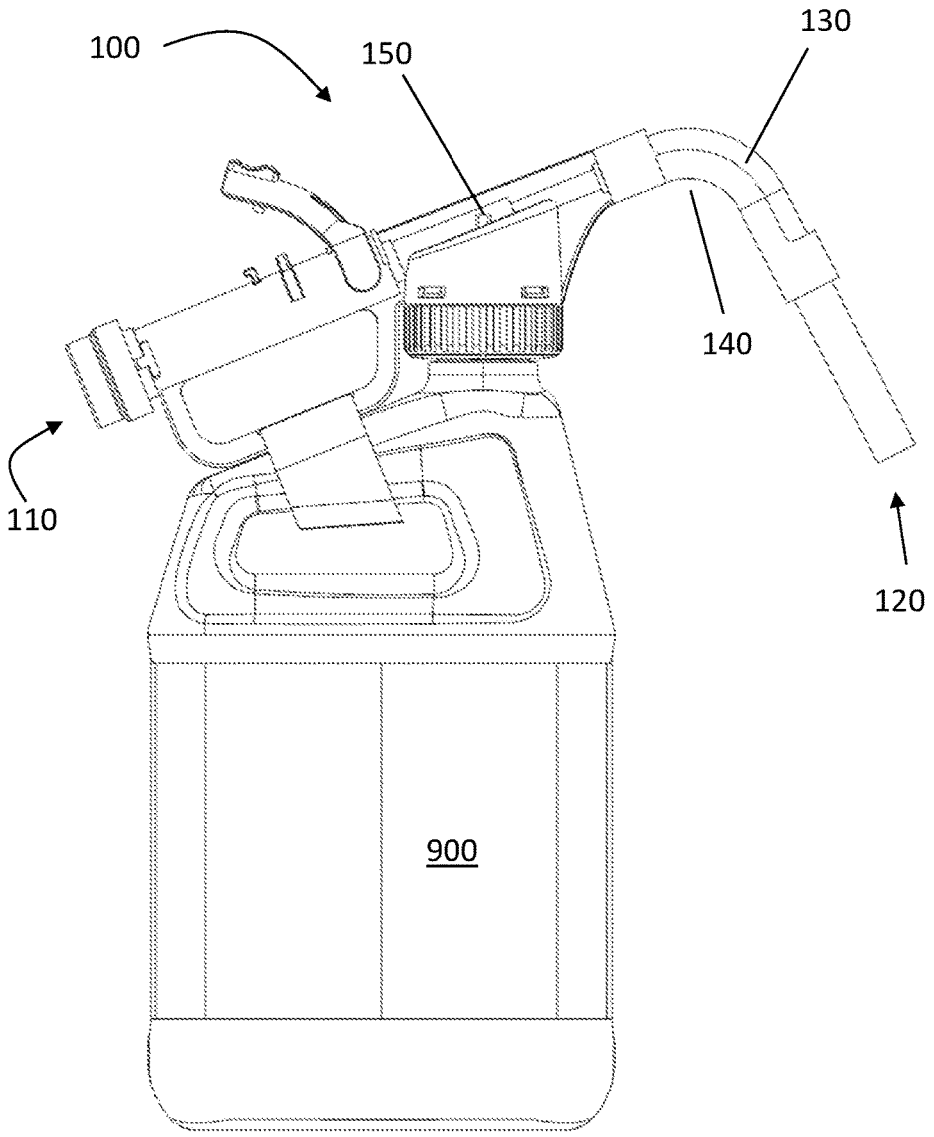
FIG. 2 illustrates a side view of a dose dispensing system according to various embodiments of the invention.
Figure 3:
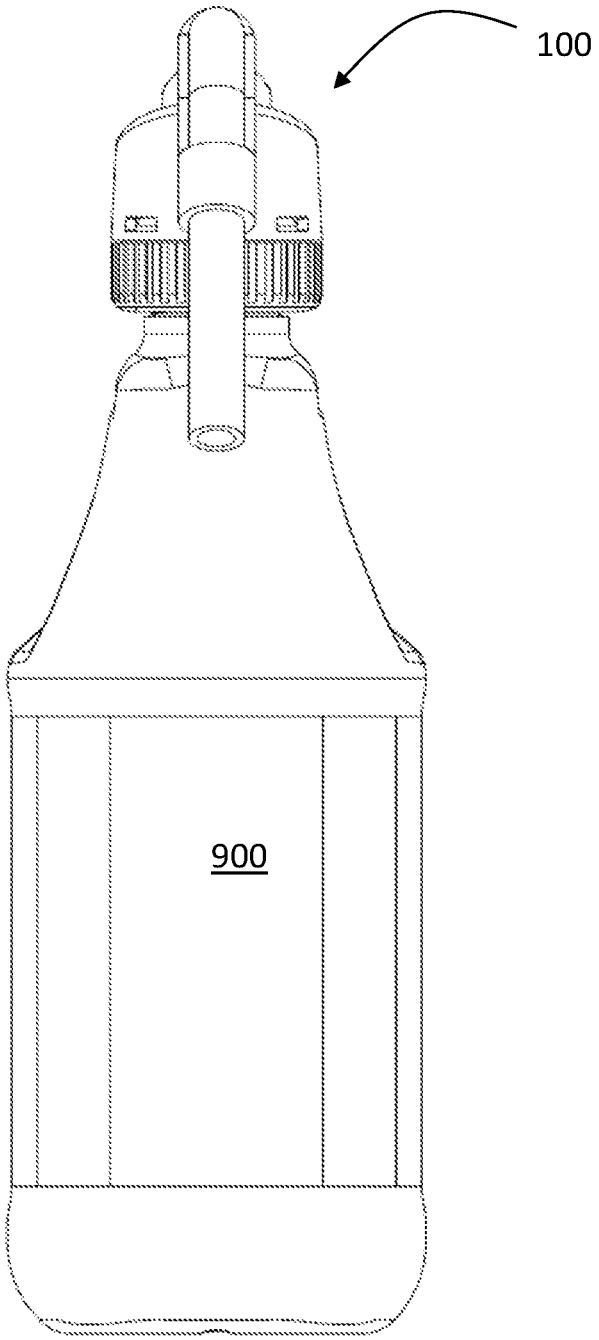
FIG. 3 illustrates a front view of a dose dispensing system according to various embodiments of the invention.
Figure 4:
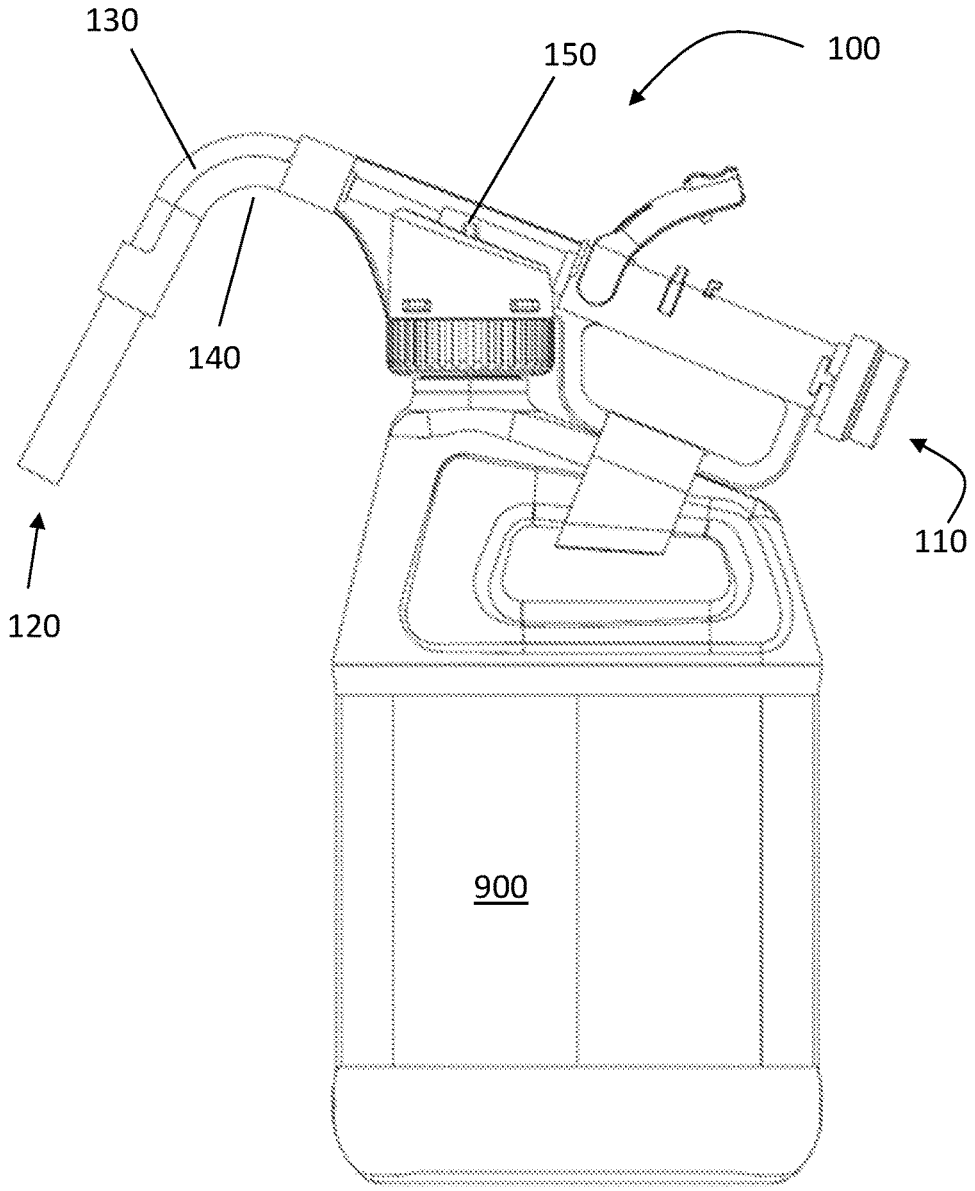
FIG. 4 illustrates an opposite side view of a dose dispensing system according to various embodiments of the invention.
Figure 5:
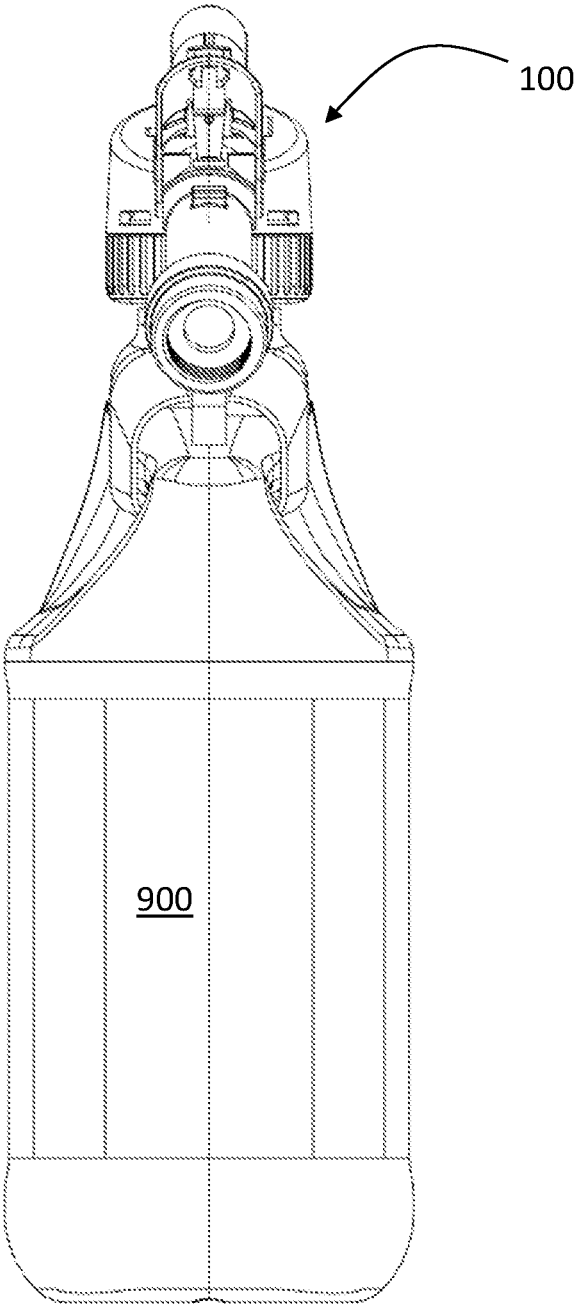
FIG. 5 illustrates a rear view of a dose dispensing system according to various embodiments of the invention.
Figure 6:
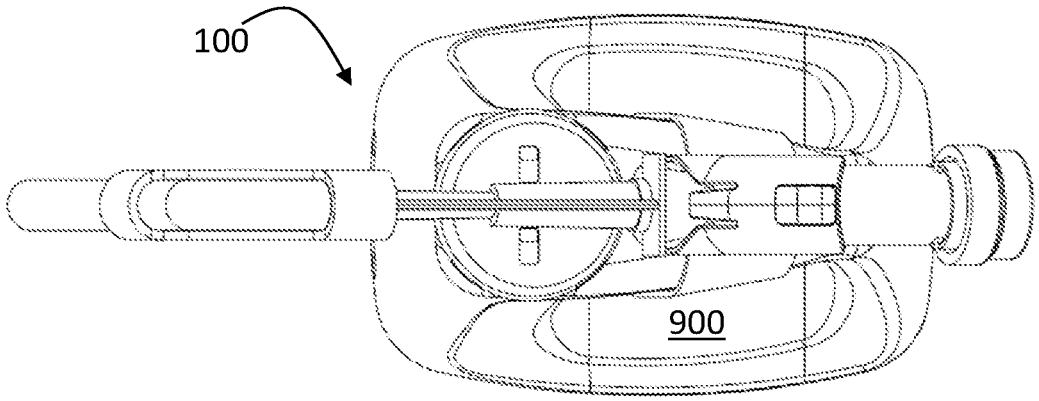
FIG. 6 illustrates a top view of a dose dispensing system according to various embodiments of the invention.
Figure 7:
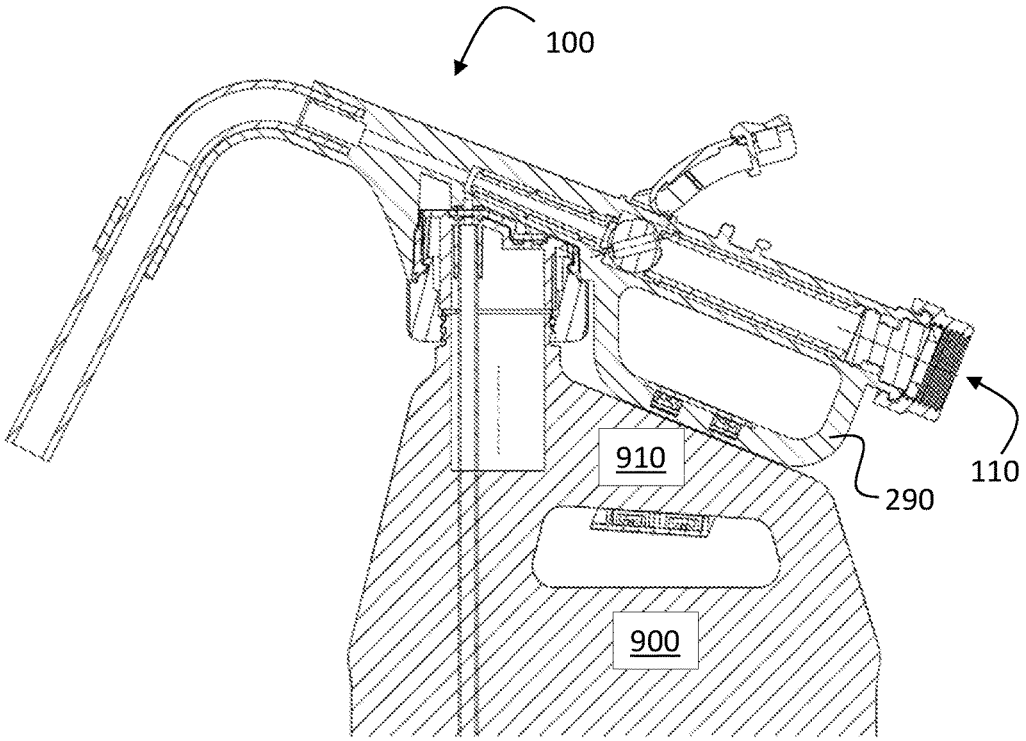
FIG. 7 illustrates a cross-sectional view of a dose dispensing system according to various embodiments of the invention.
Figure 8:
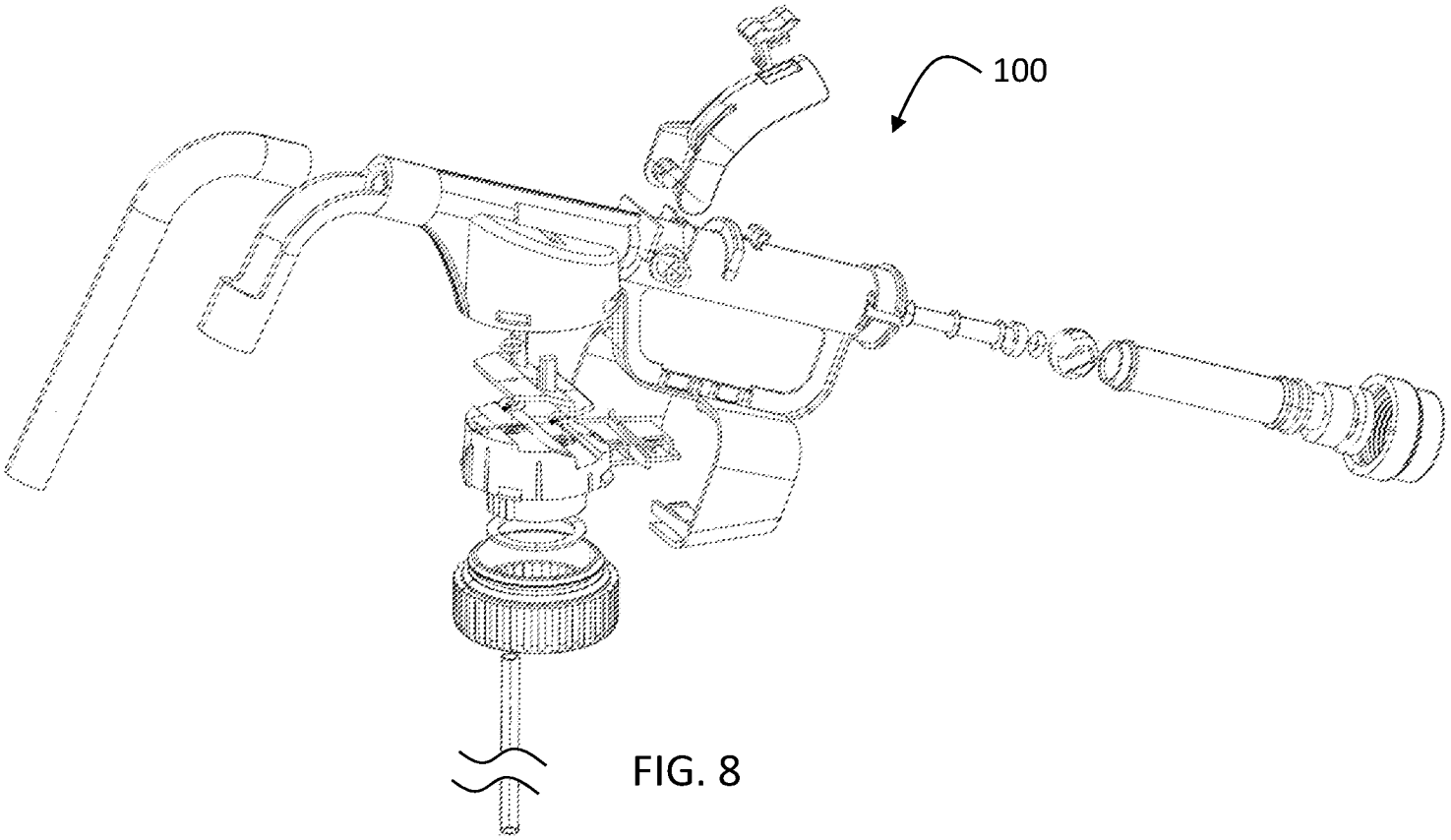
FIG. 8 illustrates the components of a dose dispensing system according to various embodiments of the invention.

According to certain embodiments of the invention, a dosing dispenser 100 may include an inlet 110 and an outlet 120. The inlet 110 may be connected to a water source or other transport medium that is configured to take up a product or chemical concentrate. For example, a hose may be screw-fit, snap-fit, quick-connect fitted, or otherwise connected to the dosing dispenser 100 at the inlet 110. As illustrated in FIG. 7, a threaded mating system may be used at the inlet 110 to connect the dosing dispenser 100 to a water source or other transport medium source.

The outlet 120 may be located at the end of a feeder tube 130. The feeder tube 130 may be angled in an appropriate direction to direct flow of water or a product laced transport medium in a desired direction. As illustrated in the Figures, in some embodiments it is desirable for the feeder tube 130 to be pointed in a downward direction towards a base of a container 900 attached to the dosing dispenser 100.

A hanger portion 140 of the dosing dispenser 100 may be configured to allow the dosing dispenser 100 and container 900 to be hung on the side of a receptacle or other container such that the dosing dispenser 100 and container 900 may be supported by the receptacle or other container without the need for a user to hold the dispensing system.

The container 900 may contain a product that can be siphoned into a flow of water or other transport medium flowing through the dosing dispenser 100. For example, using a venturi effect, a flow channel from the container 900 through a dip tube connected to the dosing dispenser 100 may pull product from the container 900 into a stream of water passing through the dosing dispenser 100.

Figure 9:
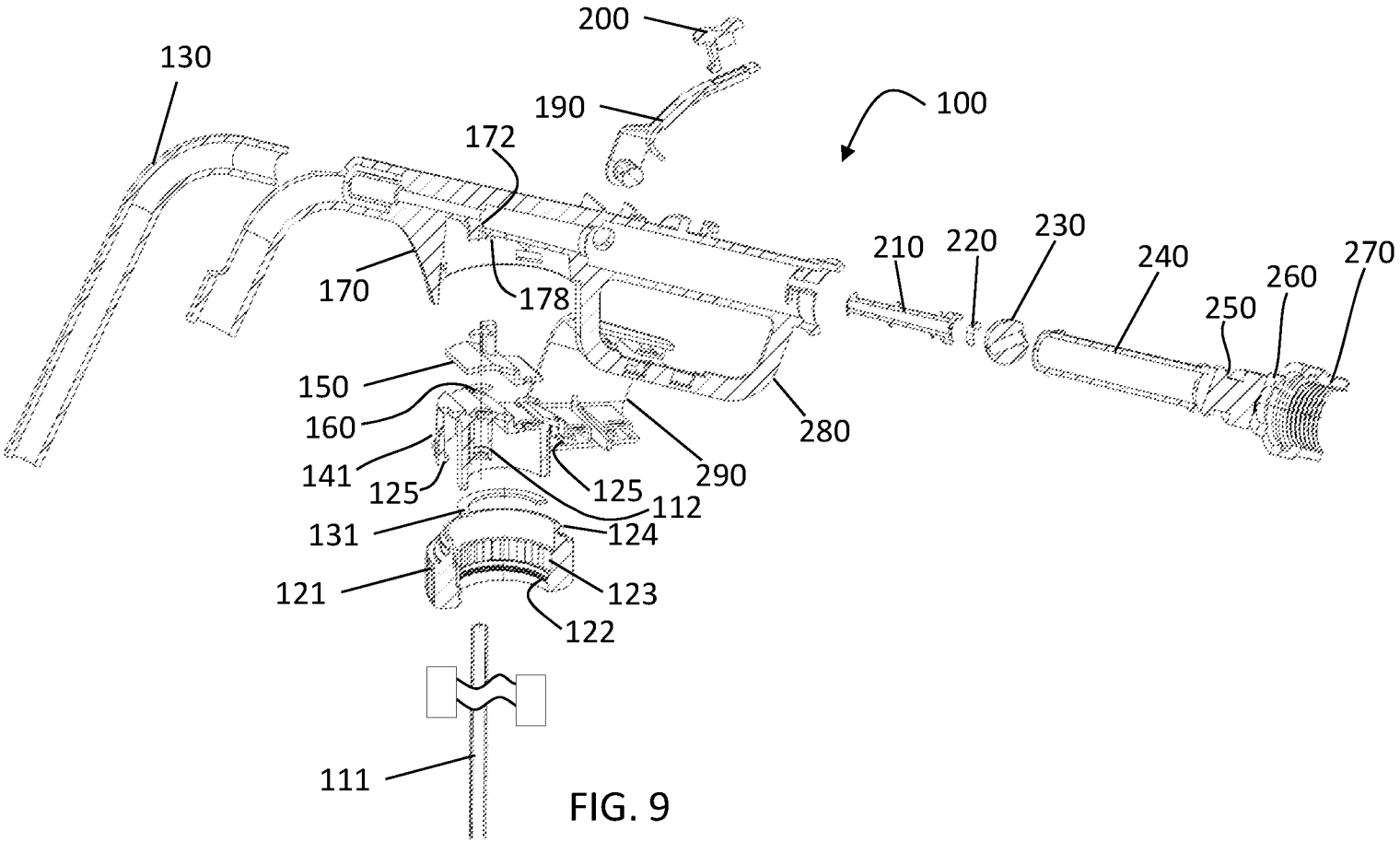
FIG. 9 illustrates a cross-sectional view of various components of a dose dispensing system according to certain embodiments of the invention.
Figure 10:
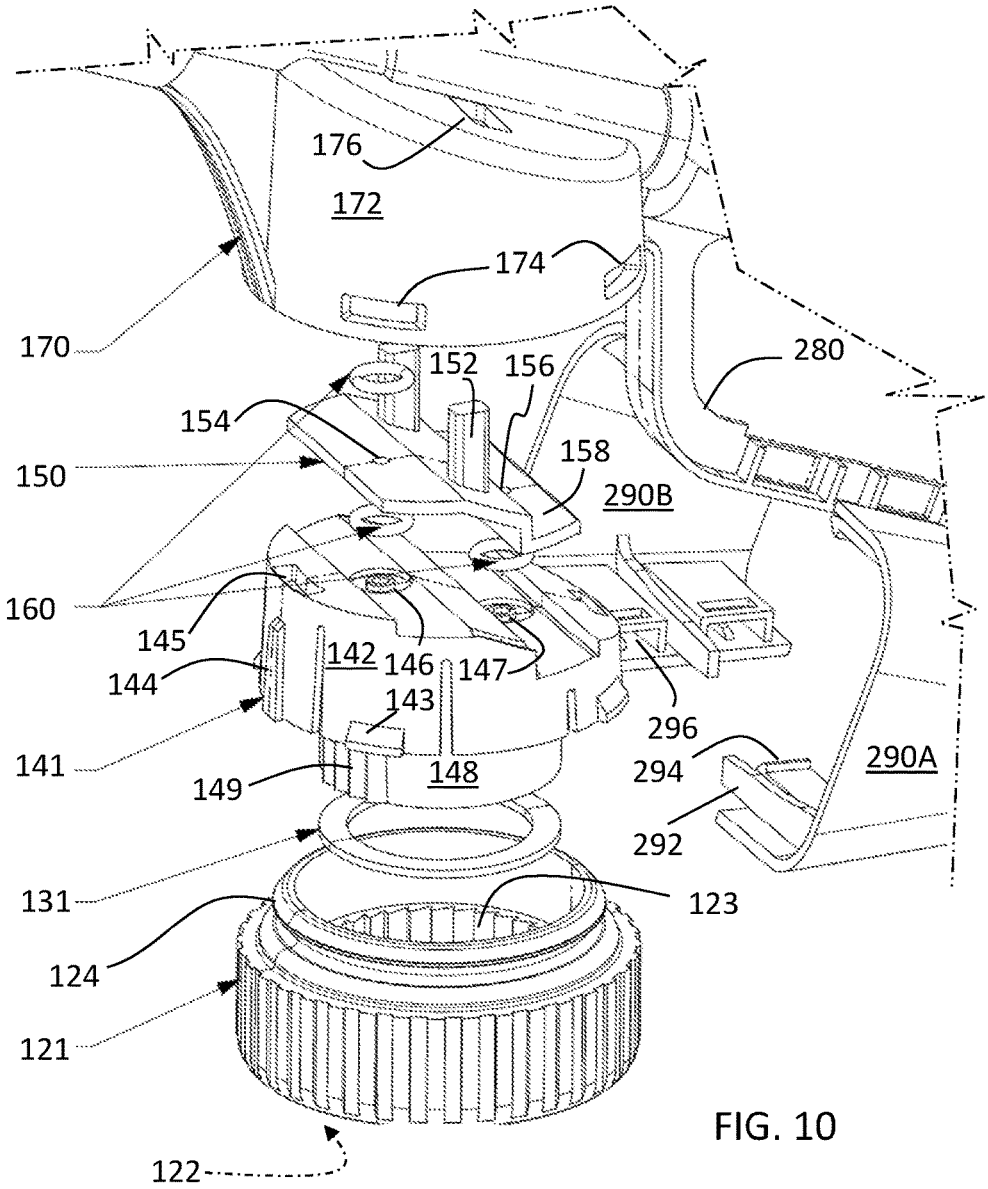
FIG. 10 illustrates a detail cross-sectional view of certain components of a dose dispensing system according to certain embodiments of the invention.

Certain components of the dosing dispenser are illustrated in an exploded view in FIG. 9 and in a detail view in FIG. 10. The components on the lower portion of FIG. 9 permit delivery of chemical from container 900 to the dosing dispenser 100. A dip tube 111 may extend from container 900 to a dip tube socket 112 in valve body 141. A container closure 121 may be provided to attach the dosing dispenser onto container 900, for example by threads 122. A container seal gasket 131 may be provided to seal the joint between valve body 141 and container 900. Valve body 141 may closely support dosing control 150, so that dosing control 150 is housed between the valve body 141 and the dispenser body 170. The dosing control 150 may include features such as flange 158 that may fit closely into or onto valve body 141 (or vice versa).

The components on the upper portion of FIG. 9 provide delivery of water or a transport stream to the dosing dispenser 100 from a source such as a garden hose. Shown from right to left, the components may include a hose nut 270 provided for a thread connection. Other devices such as quick-connect devices may be used instead of a threaded connection. A sealing device may be provided, such as a hose washer 260. A back-flow preventer 250 may also be incorporated into the dosing dispenser. A valve retainer 240 may be provided followed by a ball valve 230 with one or more O-rings 220. A valve seat 210 may receive the water or transport stream from the ball valve 230 and direct it to venturi point 172 within the dispenser body 170.

To turn on the water or transport stream, the ball valve 230 may be rotated by trigger 190. Trigger 190 may be biased toward the off (flow closed) position by a torsion bar, spring, or other suitable device. Trigger lock 200 may be provided to releasably hold the trigger in the on position.

According to certain embodiments of the invention, the flow rate of a concentrate or product in the container 900 may be controlled by movement of the dosing control 150. As illustrated, the dosing control 150 may include two selector posts 152 that allow a user to move the dosing control 150. While two selector posts 152 are illustrated, it is understood that one post may be used or that other features in place of the posts may be used to allow a user to move the dosing control 150. The dosing control 150 may be moved to select a desired flow rate of concentrate or product from the container 900 into the dosing dispenser 100 to be mixed with a water stream or transport medium stream flowing through the dosing dispenser 100. The dosing control 150 may include an on position wherein some flow of product from the container 900 into a transport medium flowing through the dosing dispenser 100 occurs and an off position wherein no product from a container 900 is allowed to flow into the transport medium flowing through the dosing dispenser 100.

In the on position, dosing control 150 may be positioned (for example, by sliding motion to align liquid passageway 154 with liquid port 146) so that a chemical flow path is opened from container 900, through dip tube 111, through liquid port 146 in valve body 141, through liquid passageway 154 in dosing control 150, and then to venturi point 172 in dispenser body 170. Sealing devices such as O-rings 160 may be provided along the chemical flow path on either side of liquid passageway 154, for example in a first recess provided in the valve body 141 and in a second recess 178 provided in dispenser body 170 adjacent venturi point 172.

If a single liquid passageway 154 is provided in dosing control 150, then the flow rate of concentrate or product in container 900 may be largely dependent upon the flow rate of water or transport medium flowing through the dosing dispenser 100. This may result in an approximately constant dispensing ratio of concentrate to water or transport medium. To obtain different dispensing ratios, the size of the liquid passageway 154 may be changed and/or additional liquid passageways may be provided in dosing control. The additional liquid passageways may have different diameters to regulate the flow of concentrate or product. Instead of providing multiple liquid passageways 154 in dosing control 150, multiple liquid ports 146 having different sizes may be provided in valve body 141.

In the on position, (with vent passageway 156 aligned with vent port 147) a vent path may be opened from container 900 through vent port 147 in valve body 141, through vent passageway 156 in dosing control 150. A sealing device such as o-ring 160 may be provided along the vent flow path on the lower side of vent port 147, for example in a third recess provided in the valve body 141.

In the off position, the chemical flow path may be closed since the liquid passageway 154 is not aligned with liquid port 146, and the vent path may be closed since the vent passageway 156 is not aligned with vent port 147.

FIG. 10 shows a detailed, exploded view of certain components that connect the dosing dispenser 100 to a container 900. To assemble these parts, they may first be placed in proximity as illustrated. Valve body 141 may then be lowered onto container closure 121 so that valve body latches 125 (seen in FIG. 9) snap over and engage upper rim 124 of container closure 121. Next the dispenser body 170 may be lowered onto valve body 141 (ribs 144 may be utilized for proper alignment) so that selector posts 152 extend up through openings 176 in dispenser body 170. Ribs 143 located on the outer perimeter 142 of the valve body 141 may engage slots 174 and hold the dispenser body 170 on valve body 141, and thence on container closure 121. Also, slots 145 in valve body 141 may engage posts with the dispenser body 170.

The assembly shown in FIG. 10 may be placed onto container 900. For containers with a container handle 910, a handle collar 290 may be attached to dispenser handle 280 to container handle 910. The handle collar 290 may stabilize the assembly, minimizing flexing forces on the container closure 121 and its connection to the valve body 141 and dispenser body 170. The handle collar 290 may be provided as two halves 290A, 290B that may encircle the container handle 910. The handle collar 290 may include alignment ribs 292. Latching features 294, 296 may be utilized to securely join together handle collar 290. While the latching features in FIG. 10 are shown on the lower portion of the handle collar 290, similar features may be provided on the upper portion of handle collar 290 to attach together the halves 290A, 290B (encircling dispenser handle 280), or to attach halves 290A, 290B to the dispenser handle 280.

Next, the container closure 121 may be rotated clockwise to attach it onto the threaded opening of the container. As the container closure 121 is rotated, closure ratchets 123 within container closure 121 are able to ride over external ratchets 149 on an inner wall 148 of the valve body. The valve body itself is prevent from rotating relative to the container 900, since it is now connected to the dispenser body 170 which in turn is connected to handle collar 290 and container handle 910.

When the container closure 121 has been tightly screwed onto the container 900, the bottle seal gasket 131 prevents leaks between the container 900 and dispenser 100. Removal of container closure 121 from container 900 is inhibited by the external ratchets 149 and closure ratchets 123. This is achieved without any need for ratchets to be provided on the container 900 itself.

A dosing dispenser 300 according to other embodiments of the invention is illustrated in FIGS. 11 through 15. As illustrated, such embodiment is similar to that illustrated in FIGS. 1 through 10 and operates in much the same manner; however, certain features and components of the embodiment illustrated in FIGS. 11 through 15 differ from those illustrated in FIGS. 1 through 10. While differences may exist, various components and functions of the different embodiments may be exchanged or combined with various embodiments of the invention.

As illustrated in FIGS. 11 through 15, a dosing dispenser 300 may include a selector 400 connected to a dosing control 350. The selector 400 may be moved to stop the flow of a carrier fluid through the dosing dispenser 300, allow flow of only a carrier fluid through the dosing dispenser 300, or allow flow of a carrier fluid combined with a product fluid from a container 900 connected to the dosing dispenser 300. In some embodiments of the invention, a selector 400 may be moved back and forth from one position to another, allowing a user to select the position—and output—of the dosing dispenser 300.

According to certain embodiments of the invention, a dosing dispenser 300 may include a latch 410 integrated with the dispenser body 370 adjacent the selector 400. A selector 400 may include one or more latches catch 412 configured to mate with or interact with the latch 410. For example, according to some embodiments of the invention, the latch 410 may fit within the latch catch 412 to prevent movement of the selector 400. The latch 410 may be flexible such that it may be moved out of a latch catch 412, allowing movement of the selector 400. Once moved, the latch 410 may be allowed to fit within a latch catch 412 associated with the selected dispensing state of the selector 400. According to some embodiments of the invention, the combination of the latch 410 and latch catch 412 may act as a child-resistant feature to prevent inadvertent movement of the selector 400.

According to various embodiments of the invention, a selector 400 may be connected to a dosing valve 450 and a dosing control 350. Movement of the selector 400 changes the position of the dosing control 350 which allows or prohibits product from a container 900 from entering into a carrier fluid flow stream in the dosing dispenser 300. Simultaneously, movement of the selector 400 changes the position of the dosing valve 450, allowing or prohibiting flow of a carrier fluid through the dosing dispenser 400.

Figure 11:
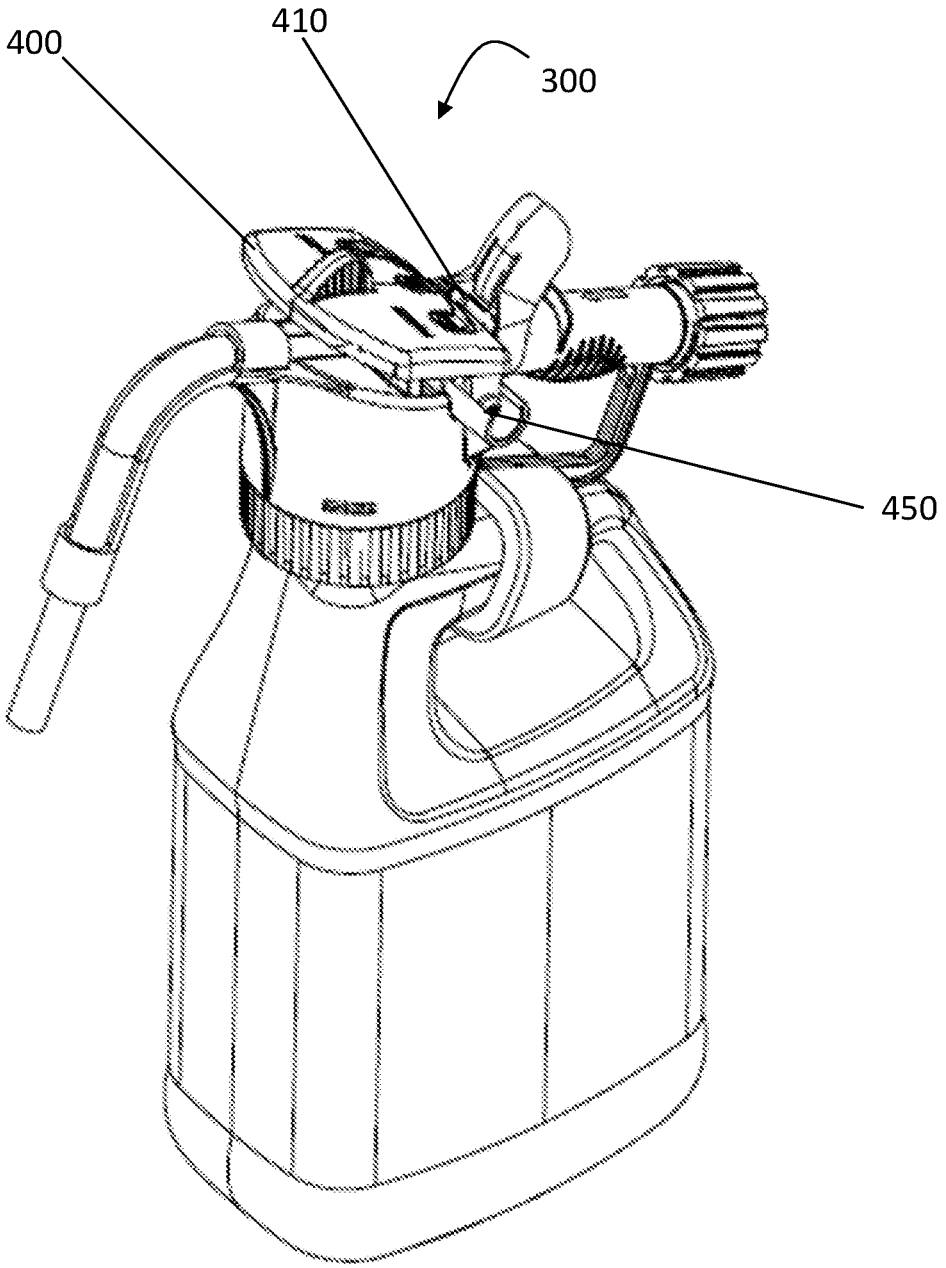
FIG. 11 illustrates a perspective of a dosing dispenser according to various embodiments of the invention.

FIG. 11 illustrates a perspective view of a dosing dispenser 300 according to various embodiments of the invention. A selector 400 may be positioned atop the dosing dispenser 300 such that a user may easily move the selector 400 to a desired dispensing configuration.

Figure 12:
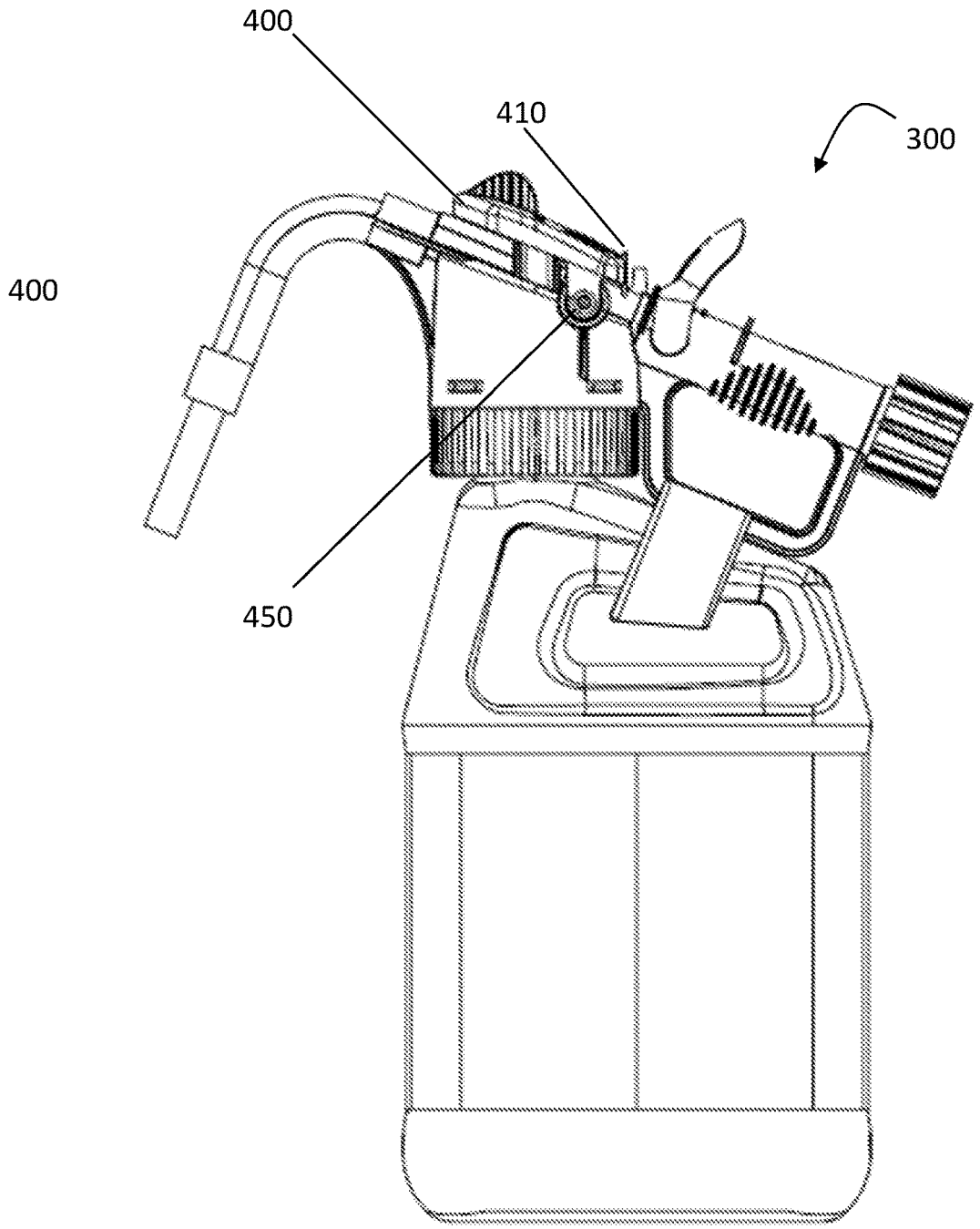
FIG. 12 illustrates a side view of a dosing dispenser according to various embodiments of the invention.

A side view of a dosing dispenser 400 according to various embodiments of the invention is illustrated in FIG. 12. As shown, in some embodiments a dosing valve 450 may sit in a channel of the dispenser body 370.

Figure 13:
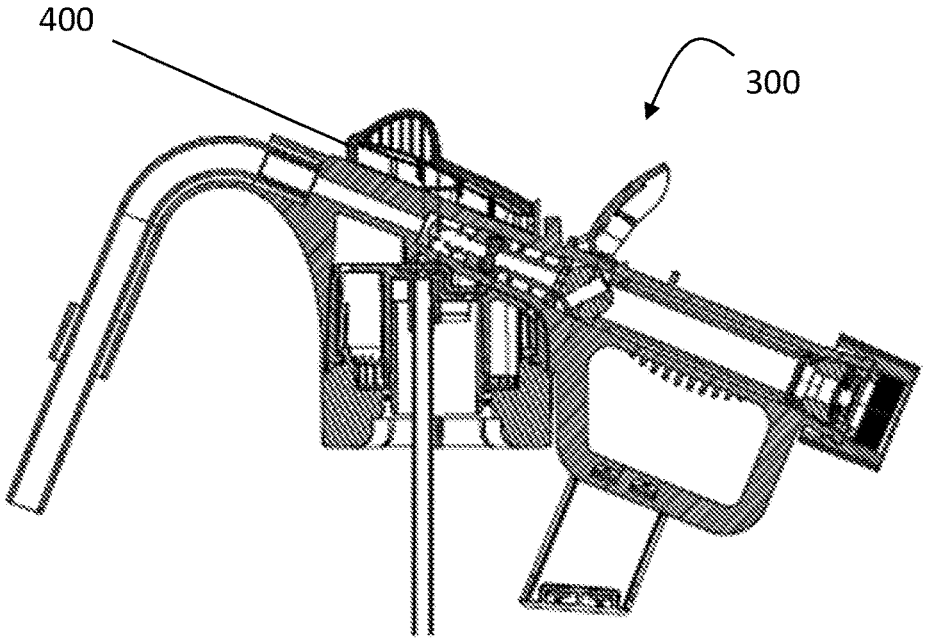
FIG. 13 illustrates a cross-sectional view of a dosing dispenser according to various embodiments of the invention.
Figure 14:
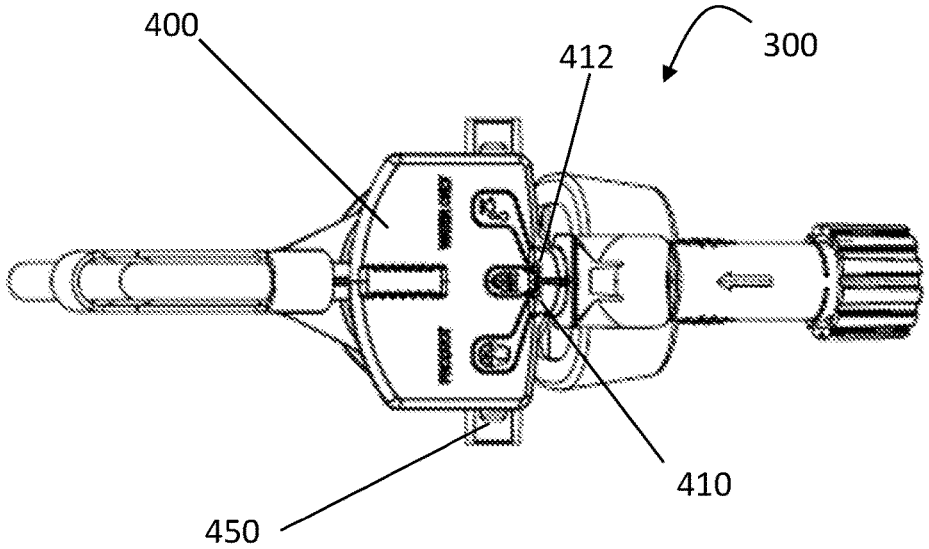
FIG. 14 illustrates a top view of a dosing dispenser according to various embodiments of the invention.

A cross-sectional view of a dosing dispenser 300 is illustrated in FIG. 13. A top-down view of a dosing dispenser 300 showing a selector 400 is illustrated in FIG. 14. A selector 400 may include a number of latch catches 412. For example, the dosing dispenser 300 illustrated in FIG. 14 includes three latch catches 412: a first latch catch 412 representing an off position where both carrier fluid and product are prevented from flowing through the dosing dispenser 300; a second latch catch 412 for delivering just a carrier fluid or water from the dosing dispenser 300; and a third latch catch 412 for delivering both a carrier fluid and a product from the dosing dispenser 300. As illustrated in FIG. 14, the first latch catch 412 may be located between the second and third latch catch 412. A latch 410 may be seated in a latch catch 412 as illustrated, preventing movement of the selector 400 without first moving the latch 410.

Figure 15:
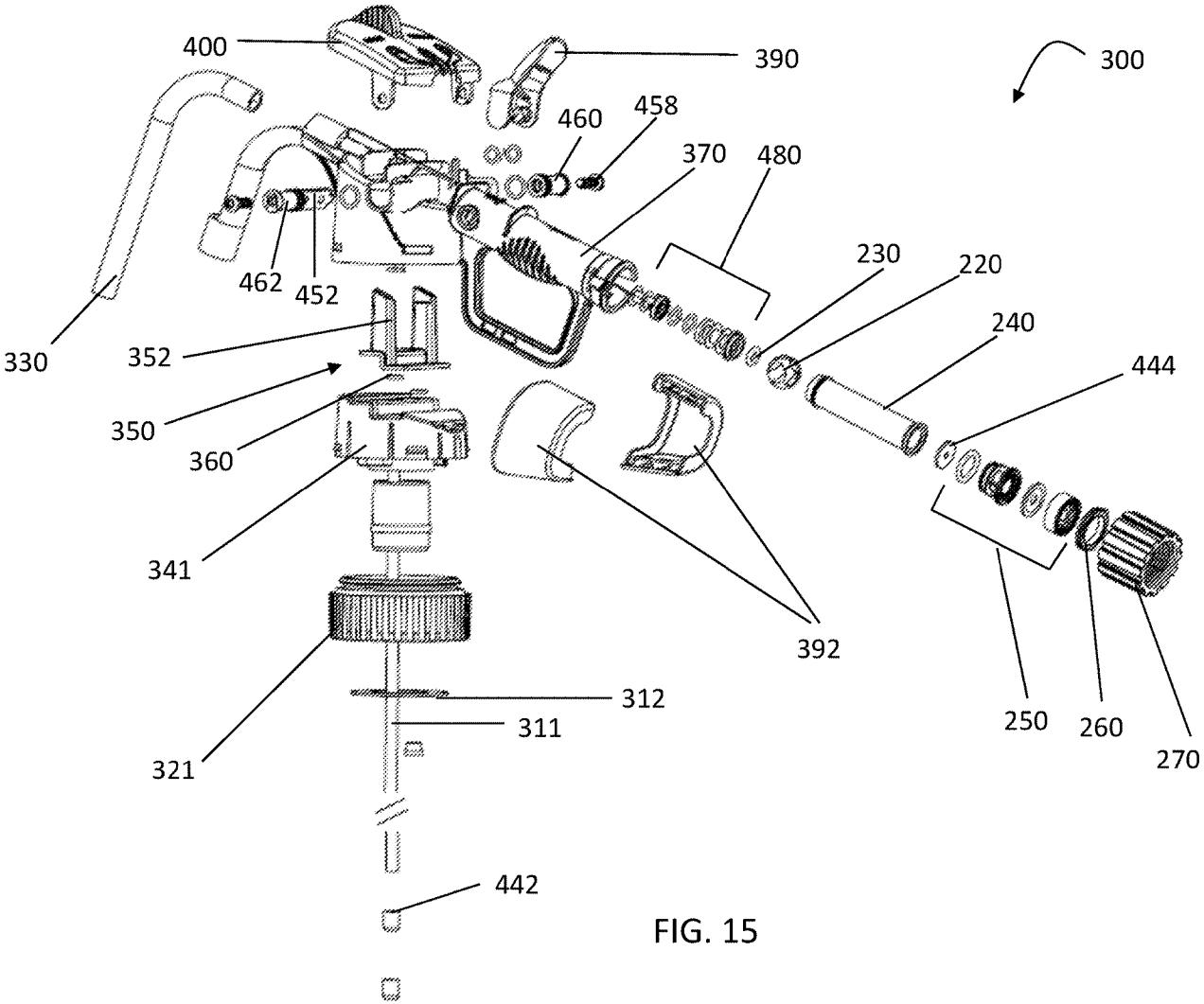
FIG. 15 illustrates a blown-apart assembly view of a dosing dispenser according to various embodiments of the invention.

Components making up a dosing dispenser 300 are illustrated in FIG. 15. As illustrated, a dosing dispenser 300 according to some embodiments of the invention may include a dispenser body 370 to which various components may be attached or assembled.

In some embodiments of the invention, a valve seat 480 may be assembled and inserted into a cavity within the dispenser body 370. The valve seat 480 may include a front seat portion and a rear seat portion with two o-rings positioned between the front seat portion and the rear seat portion. The valve plate 452 portion of a dosing valve 450 may seat between the front seat portion and the rear seat portion such that the o-rings associated therewith—along with the valve plate 452—restrict the flow of a carrier fluid through the dosing dispenser 300. For example, the front seat portion and the rear seat portion each include flow channels through such components. When a valve plate 452 is aligned with a valve opening in communication with the flow channels, fluid may flow through the valve seat 480. However, if the valve plate 452 is moved such that an opening therein is not aligned with the flow channels, fluid is prevented from flowing through the dosing dispenser 300. Thus, when the dosing valve 450 is aligned in the off position, openings in the valve plate 452 are not aligned with the flow channels and fluid does not flow through the valve seat 480. However, when the selector 400 is moved to a carrier fluid flow position or a carrier fluid and product flow position, valve openings in the valve plate 452 align with the fluid channels, allowing a carrier fluid to flow through the valve seat 480.

Upstream of the valve seat 480, an o-ring 220, ball valve 230, valve retainer 240, backflow preventer 250, hose washer 260 and hose nut 270 may be assembled as illustrated. In addition, in certain embodiments of the invention, a flow restrictor r may be inserted after the backflow preventer to limit the amount of carrier fluid flow through the dosing dispenser 300. For instance, in some embodiments it may be desirable to have a flow rate of four-gallons per minute of carrier fluid through the dosing dispenser 300 while in other embodiments it may be desirable to have a lower flow rate—such as two gallons per minute. Rather than scaling all of the components of the dosing dispenser 300 to make the smaller version, a flow restrictor 444 may be assembled with the dosing dispenser 300 to adjust or decrease the flow rate through the dosing dispenser 300. According to various embodiments of the invention, a flow restrictor 444 may have any desired size and may be configured to provide a desired flow rate through the dosing dispenser 300.

A valve body 341 and dosing control 350 may be assembled to the dispenser body 370 as illustrated. Two or more o-rings 360 may be seated between the valve body 341 and the dosing control to seal a product fluid flow path and a vent in the valve body 341. As with other embodiments of the invention, movement of the dosing control 350—through movement of the selector posts 352—may control the flow of product from a container 900 into a body or cavity of the dosing dispenser 300.

A selector 400 may be assembled to the dispenser body 370 and be configured to be in communication with a dosing valve 450 and the dosing control 350. Movement of the selector 400 moves the dosing valve 450 and the dosing control 350 to allow or restrict the flow of carrier fluid and product through the dosing dispenser 300. For instance, in an "off" position, the selector 400 seats the valve plate 452 in the valve seat 480 such that fluid cannot flow through the dosing dispenser 300. While various embodiments of the invention may include a ball valve 220 that can be turned off with a trigger 390, the inclusion of an "off" selection on the selector 400 provides additional safety to prevent flow of fluid through the dosing dispenser 300. When moved to a "carrier fluid only" position, an opening in the valve plate 452 is aligned with flow channels in the valve seat 480 such that carrier fluid may flow through the dosing dispenser 300 without allowing product into the stream. When placed in a "product" configuration or position, the selector 400 moves the valve plate 452 such that an opening therein is aligned with the fluid flow channels of the valve seat 480 and so that the dosing control 350 is seated on the valve body 341 to allow product to flow into the carrier fluid flow by a venturi effect.

A dosing dispenser 300 may also include a container closure 321, dip tube 311, and gasket 312 as illustrated. In addition, in some embodiments, a restriction cap 442 may be placed on the end of a dip tube 311. For instance, when a flow restrictor 444 is used with embodiments of the invention, a restriction cap 442 may be placed on the dip tube 311 to reduce the flow of product into the carrier fluid stream. The use of the restriction cap 442 allows the ratio of product-to-carrier fluid to be controlled. For example, if it is desired to step down the flow rate of carrier fluid from four gallons per minute to two gallons per minute and the same ratio of product to carrier fluid is desired, the amount of product that can flow into the carrier stream must be reduced. In certain embodiments of the invention this may be accomplished by including a restriction cap 442 on the dip tube 311.

As illustrated, various components are assembled to construct a dosing dispenser according to various embodiments of the invention. While such components may be used to construct the dosing dispenser, other configurations may be used with various embodiments of the invention as well.

What is claimed is:

1. A dosing dispenser system, comprising:
- a container; and
- a dosing dispenser attached to the container, wherein the dosing dispenser comprises:
  - an inlet;
  - an outlet;
  - a sliding valve plate disposed within the dosing dispenser configured to regulate the flow of a first fluid from the inlet through the dosing dispenser;
  - a sliding dosing control configured to regulate the flow of a second fluid from the container into the dosing dispenser; and
  - a sliding selector in communication with both the sliding valve plate and the sliding dose control, wherein sliding movement of the sliding selector moves both the sliding valve plate and the sliding dosing control.

2. The dosing dispenser system of claim 1, wherein the dosing control is a slidable plate.

3. The dosing dispenser system of claim 1, wherein the dosing control includes an off position wherein no product flows into the dosing dispenser and an on position where some product flows into the dosing dispenser.

4. The dosing dispenser system of claim 1, wherein the container has a threaded opening and the dosing dispenser further comprises a threaded container closure.

5. The dosing dispenser system of claim 4, wherein the threaded container closure is permanently threaded onto the container opening without the use of any ratchets on the container opening itself.

6. The dosing dispenser system of claim 1 further comprising:
- a latch connected to the dispenser body adjacent the sliding selector; and
- at least one latch catch on the selector.

7. A dosing dispenser for dispensing from a container, comprising:
- an inlet;
- an outlet;
- a valve seat;
- a sliding valve disposed in the valve seat, the sliding valve configured to regulate the flow of a first fluid from the inlet through the valve seat;
- a sliding dosing control configured to regulate the flow of a second fluid from the container into the dosing dispenser; and
- a sliding selector in communication with the sliding valve plate and the sliding dosing control, the sliding selector configured to move the valve plate and the dosing control upon actuation of the sliding selector.

8. The dosing dispenser of claim 7, wherein the dosing control is a slidable plate.

9. The dosing dispenser of claim 7, wherein the dosing control includes an off position wherein no product flows into the dosing dispenser and an on position where some product flows into the dosing dispenser.

10. The dosing dispenser of claim 8 further comprising:
- a latch connected to the dispenser body adjacent the sliding selector; and
- at least one latch catch on the selector.

11. The dosing dispenser of claim 9 further comprising:
- a latch connected to the dispenser body adjacent the sliding selector; and
- at least one latch catch on the selector.

12. The dosing dispenser system of claim 1 further comprising
- a ball valve disposed between the sliding valve plate and the outlet; and
- a trigger configured to rotate the ball valve.

13. The dosing dispenser system of claim 1 further comprising a handle collar assembled with the dispenser.

14. The dosing dispenser of claim 7, wherein the valve seat further comprises:
- a front seat portion;
- a rear seat portion; and
- at least two O-rings, wherein the front seat portion and one O-ring are adjacent a first side of the valve plate and the second seat portion and one O-ring are adjacent an opposite second side of the valve plate.

15. The dosing dispenser of claim 7 further comprising
- a ball valve disposed between the sliding valve plate and the outlet; and
- a trigger configured to rotate the ball valve.

16. The dosing dispenser of claim 7 further comprising a handle collar assembled with the dispenser.

* * * * *